US005170534A

United States Patent [19]

Marx et al.

[11] Patent Number: 5,170,534

[45] Date of Patent: Dec. 15, 1992

[54] APPARATUS FOR CLEANING THE SURFACE OF TEXTILE FIBER BALES

[75] Inventors: Hans-Jürgen Marx, Jüchen; Andreas Kranefeld, Erkelenz; Ferdinand Leifeld, Kempen; Josef Temburg, Jüchen, all of Fed. Rep. of Germany

[73] Assignee: Trützchler GmbH & Co. KG, Mönchengladbach, Fed. Rep. of Germany

[21] Appl. No.: 628,143

[22] Filed: Dec. 17, 1990

[30] Foreign Application Priority Data

Dec. 19, 1989 [DE] Fed. Rep. of Germany ..... 3941858

[51] Int. Cl.[5] ..... D01B 3/00; D01G 7/00

[52] U.S. Cl. ..... 19/202; 19/80 R

[58] Field of Search ..... 19/0.21, 80 R, 80 A, 19/96, 97, 97.5, 200, 202, 66 R, 66 CC

[56] References Cited

U.S. PATENT DOCUMENTS

| | | | |
|---|---|---|---|
| 1,944,271 | 1/1934 | Riedling | 19/80 R |
| 3,239,888 | 3/1966 | Diesel | 19/80 R |
| 3,251,096 | 5/1966 | Rapp | 19/80 R |
| 3,686,714 | 8/1972 | Wirth | 19/80 R |
| 4,297,767 | 11/1981 | Leifeld | 19/80 R |
| 4,377,021 | 3/1983 | Peters | 19/80 R |
| 4,557,021 | 12/1985 | Nash et al. | 19/80 R |
| 4,707,887 | 11/1987 | Leifeld et al. | 19/80 R |
| 4,888,857 | 12/1989 | Pinto et al. | 19/80 R |
| 4,891,863 | 1/1990 | Bahlmann et al. | 19/80 R |
| 4,979,271 | 12/1990 | Binder et al. | 19/80 R |
| 4,995,142 | 2/1991 | Binder et al. | 19/97 |

FOREIGN PATENT DOCUMENTS

| | | | |
|---|---|---|---|
| 3135272 | 3/1983 | Fed. Rep. of Germany | 19/80 R |
| 3436498 | 4/1986 | Fed. Rep. of Germany . | |
| 3446758 | 7/1986 | Fed. Rep. of Germany . | |
| 3706268 | 9/1988 | Fed. Rep. of Germany | 19/97 |
| 1102418 | 5/1986 | Japan | 19/97.5 |
| 1207628 | 9/1986 | Japan | 19/80 R |
| 3274863 | 11/1988 | Japan | 19/80 R |

*Primary Examiner*—Werner H. Schroeder
*Assistant Examiner*—Michael A. Neas
*Attorney, Agent, or Firm*—Spencer, Frank & Schneider

[57] ABSTRACT

An apparatus for treating a fiber bale having a soiled surface. The apparatus includes a cleaning device arranged for engaging a bale surface to remove soiled material therefrom and a displacing arrangement for effecting a relative motion between the fiber bale and the cleaning device.

24 Claims, 3 Drawing Sheets

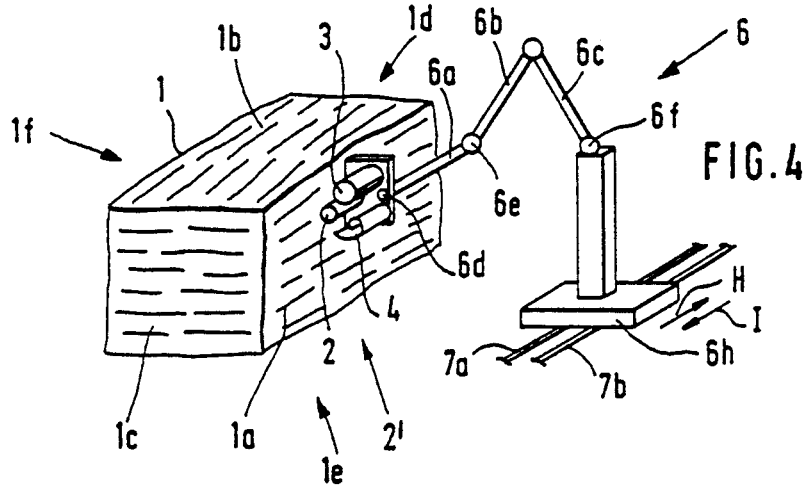
FIG.4
FIG.5a
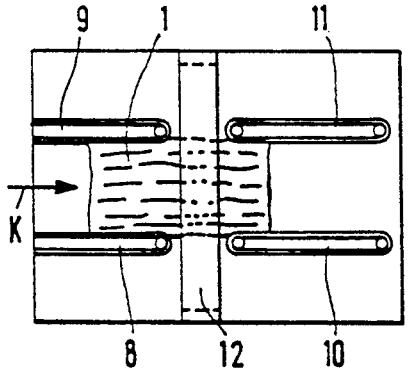
FIG.5b
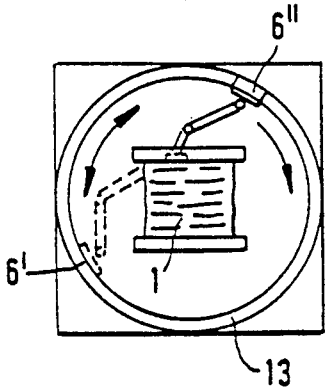
FIG.6
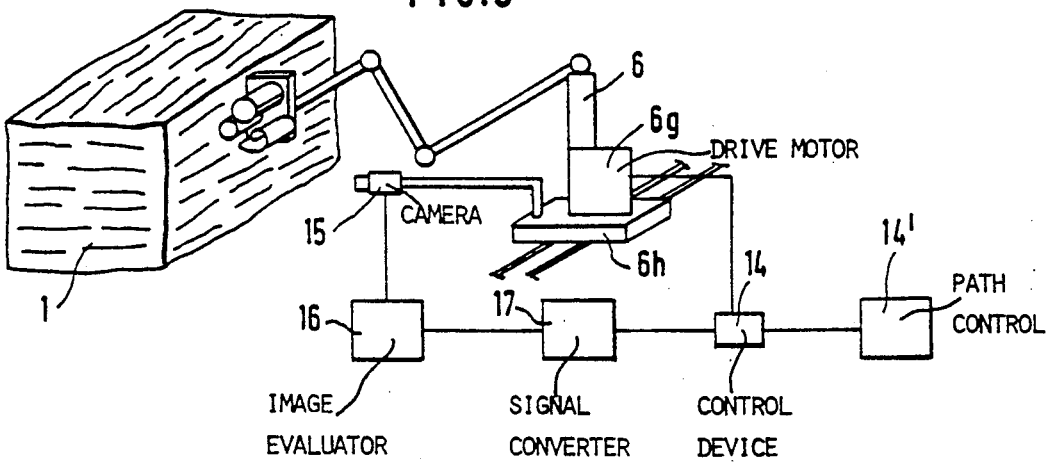

APPARATUS FOR CLEANING THE SURFACE OF TEXTILE FIBER BALES

BACKGROUND OF THE INVENTION

This invention relates to an apparatus for treating textile fiber bales such as cotton bales, chemical fiber bales and the like which have surfaces soiled with oil, mud or the like.

Generally, fiber bales are transported in sacks and are held together by straps such as steel bands, wire and the like. Before packaging or upon removal of the wrapping material, the fiber bales are often exposed to soiling for example by oil, grease, mud and the like which adversely affect the subsequent processing of the fiber material in the cleaning or carding lines. Such contamination is difficult to remove in the cleaning and carding machines. Dirt which is visible upon removal of the wrapper is particularly disadvantageous.

SUMMARY OF THE INVENTION

It is an object of the invention to provide an improved apparatus of the above-outlined type which eliminates the discussed disadvantages and which, in particular, makes possible a secure removal of dirt from the bale surfaces.

This object and others to become apparent as the specification progresses, are accomplished by the invention, according to which, briefly stated, a cleaning device is provided which engages the bale surfaces and is movable relative thereto.

Thus, according to the invention the soiled portions of the bale surfaces are removed by the cleaning device. Thereafter the fiber bales may be opened (that is, fiber tufts may be removed therefrom) and the fiber tufts further processed.

According to a further feature of the invention, the cleaning device has at least one cleaning roll which is moved relative to the bale surface. Expediently, a rapidly rotating stripping roll is associated with the cleaning roll which is cleaned by the stripping roll having a high circumferential speed and being exposed to high centrifugal forces. According to a further feature of the invention, the cleaning roll is provided with a sawtooth clothing. Preferably, the clothing of the stripping roll is arranged at a small distance from the cleaning roll. According to a further feature of the invention, the cleaning roll and/or the stripping roll is associated with a collecting and suction removal device for the removed impurities.

According to a further feature of the invention, the collecting and suction removal device has a stripping edge which cooperates with the clothing of the stripping roll. The material thrown by the stripping roll flies directly into a suction hood and is removed therefrom by a suction air stream. The stripping roll is preferably provided with a brush clothing formed of long bristles. Preferably, the circumferential speed of the cleaning roll is greater than approximately 10 m/min. Preferably, the circumferential speed of the stripping roll is greater than approximately 300 m/min.

For cleaning of the bottom and top surfaces of the fiber bale, a hold-down device is necessary because of the layered structure of the fiber bale. The hold-down device prevents removal of entire layers from the fiber bale. The cleaning roll and the stripping roll may extend over the entire bale face or bale height and may travel therealong. Preferably, the cleaning apparatus is designed such that all six faces of the fiber bales may be cleaned. Preferably, the cleaning roll has a shorter length than the width of the fiber bale, (and thus has a length of about 300 mm) because cleaning rolls which extend over the entire bale surface are disadvantageous in that fibers are also removed from clean areas which significantly increases waste.

Expediently, the pressing force applied by the cleaning roll on the bale may be adjusted. According to a further feature of the invention, there is provided a turning device for the fiber bales, for example, a pivoting or tilting device, a fork-type manipulator or the like.

Preferably, the cleaning device is mounted on a multi-axis robot which is movable relative to the fiber bales. Preferably, the robot is arranged in a plane which extends perpendicularly to the conveying direction of the fiber bales and the robot may travel on a circular track through 180° about the fiber bales. Preferably, the cleaning device mounted on the robot engages the fiber bale between two bale transporting devices. Preferably, the driving devices for the robot and the bale transport apparatus are electrically interconnected to ensure that the cleaning device may work on all surfaces of the fiber bale.

According to a further feature of the invention, a detecting device such as a TV camera or the like is provided which recognizes shades or colors and which may be moved relatively to the bale surface. Preferably, the TV camera is connected with an image evaluating device.

According to a further feature of the invention, a control device is provided which is connected to the path control device for the robot. Preferably, the driving device for the bale turning apparatus and/or the image evaluating device and/or the bale transport device are connected to the control device.

According to the invention, the cleaning roll is mounted on the multi-axis robot and is brought into a position at the fiber bale surface where soiling has been detected. Such a positioning may be effected either manually or automatically. For an automatic control of the robot, the TV camera with associated image evaluation and path control for the robot may be used. The robot may reach easily the four lateral sides of the bales, but for gaining access to the bottom and top sides, the bale turning system is required. The control of the robot system cooperates with the control of the bale turning system. The dwelling time of the cleaning roll at a soiled location of the fiber bale surface depends from the shade of such location, as detected by the TV camera and determined by the evaluating device associated with the camera. The darker location, the longer the dwelling time of the cleaning roll. The pressing force of the cleaning roll is variable and also depends on the detected shade of the soiled location. Preferably, the dwelling time and applied pressure are jointly regulated as a function of the shade of the soiled location. After treatment by the cleaning device, the treated location is inspected by the camera and, if necessary, a supplemental cleaning operation is performed thereon.

The bale cleaning machine according to the invention is expediently a component of a bale processing line and is connected with the master control of the processing line. The desired shade or color of the cleaned bales may be set and thus adapted to the different base colors of different fiber types. The desired shades may be obtained from a bale control computer of the machine control for the cleaning line.

The invention further encompasses an embodiment which includes a bale opener (that is, a fiber tuft removing apparatus). The bale opener which includes a tower mounted on a carriage movable along a fiber bale series and an opening device mounted in a cantilever fashion on the tower and movable vertically relative to the tower is preferably associated with the cleaning device which is mounted either on the tower or the cantilever opening device.

BRIEF DESCRIPTION OF THE DRAWING

FIG. 4 is a perspective view of a robot carrying a cleaning device illustrated in FIG. 1.

FIG. 5*a* is a schematic side elevational view illustrating a fiber bale shifting device.

FIG. 5*b* is a schematic front elevational view illustrating a circular track for the travel of a robot shown in FIG. 4.

FIG. 6 is a schematic perspective view, with block diagram, of a control associated with a robot/cleaner assembly as shown in FIG. 4.

DESCRIPTION OF THE PREFERRED EMBODIMENTS

Figure 1:
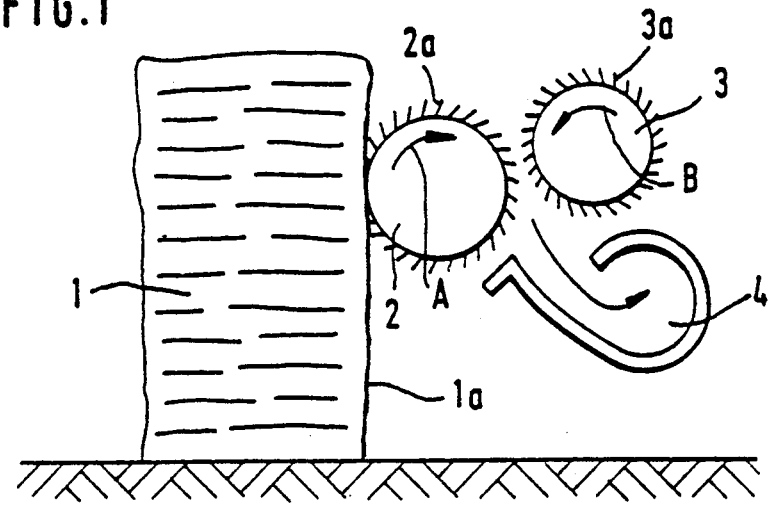
FIG. 1 is a schematic side elevational view of a cleaning device according to a preferred embodiment of the invention.

Turning to FIG. 1, there is illustrated therein a cleaning roll 2 which is provided with a clothing 2*a* and which works on a vertical face 1*a* over a fiber bale 1. With the cleaning roll 2 there is associated a stripping roll 3 which is provided with a clothing 3*a* and which serves for removing impurities, such as soiled fiber from the cleaning roll 2. The points of the clothings 2 and 3 are arranged at a small distance from one another. The cleaning roll 2 rotates in the direction of arrow A with a circumferential speed of approximately 12.5 m/min to 125 m/min and has a diameter of, for example, 200 mm. The stripping roll 3 is rotated in the direction of the arrow B and has a circumferential speed of approximately 345 m/min to 520 m/min and has a diameter of, for example, 110 mm. With the stripping roll 3 a collecting and suction removal device 4 is associated to carry away soiled fiber taken from the fiber bale by the cleaning roll 2.

Figure 2:
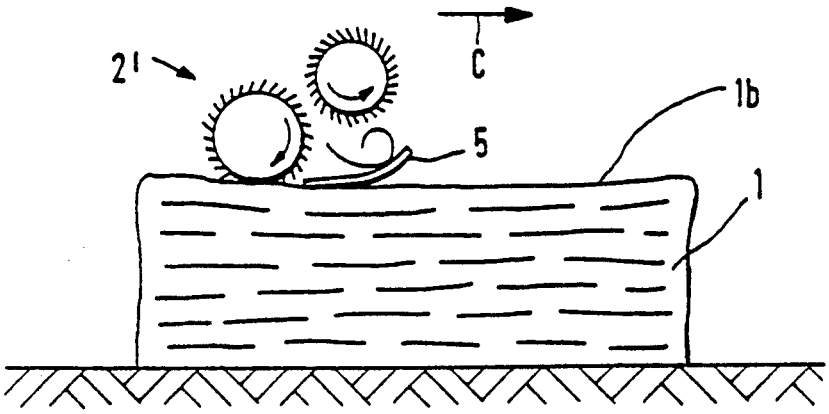
FIG. 2 is a schematic side elevational view of another preferred embodiment of the invention.

Turning to FIG. 2, the cleaning roll 2 is working on the upper, horizontal surface 1*b* of the fiber bale 1 and is associated with a hold-down device 5 which presses against the surface 1*b*. The cleaning device generally designated at 2' moves in the working direction indicated by the arrow C.

Figure 3A:
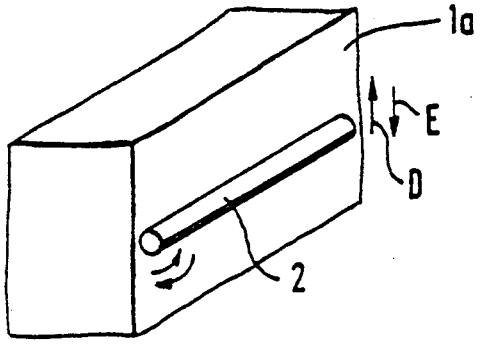
FIG. 3*a* is a schematic perspective view of a cleaning roll movable in a vertical working direction.
Figure 3B:
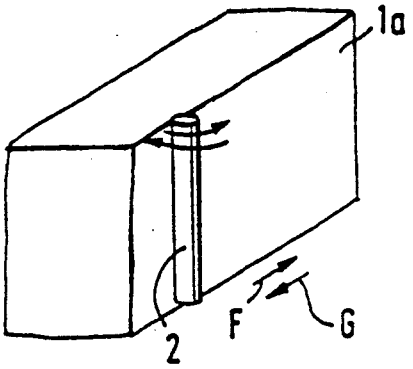
FIG. 3*b* is a schematic perspective view of a cleaning roll movable in a horizontal working direction.

Turning to FIG. 3*a*, the cleaning roll 2 is movable vertically in the direction of arrows D and E relative to the vertical lateral bale face 1*a*. As shown in FIG. 3*b*, the cleaning roll 2 is movable in a horizontal direction as indicated by the arrows F and G relative to the lateral vertical bale face 1*a*.

Turning to FIG. 4, the cleaning device 2', including the cleaning roll 2, the stripping roll 3 and the collecting and suction removal device 4 is mounted at the end of a rotatable and swingable arm 6*a* of a multi-axis robot 6 which is movable on rails 7*a*, 7*b* in the direction of arrows I, H along the fiber bale 1. Between the robot arms 6*a*, 6*b* and 6*c* there are provided articulations 6*d*, 6*e* and 6*f* so that the cleaning roll 2 may gain access to the surfaces 1*a*, 1*b*, 1*c* and 1*d* of the fiber bale 1.

Turning to FIG. 5*a*, the fiber bale 1 is movable by and between conveyor belts 8, 9, 10 and 11 in the direction of the arrow K. Between the pair formed of belts 8 and 9 and the pair formed of belts 10 and 11 there is provided a clearance 12 about which a circular track 13 is arranged as shown in FIG. 5*b*. On the track 13 carriages for two robots 6' and 6'' may move through 180° perpendicularly to the bale feed direction K. In this manner all four sides of the bale 1 are being cleaned. The joint 6*d* of at least one of the robots 6', 6'' is rotatable through 90° in the working direction K so that the front and rear faces of the fiber bale may also be cleaned.

In FIG. 6 a multi-axis robot 6 is shown whose motions in the various axial directions are controlled by robot actuators associated with drive motors. The drive motor 6*g* is electrically connected with a control device 14 to which a path control device 14' and the drive motor for the carriage 6*h* are also connected. On the carriage 6*h* there is further mounted a camera 15, such as CCD (charge coupled device) which optically scans the surface of the bale 1. The camera 15 is connected by an electronic image evaluating device 16 and a signal converter 17 with the control device 14.

Figure 7A:
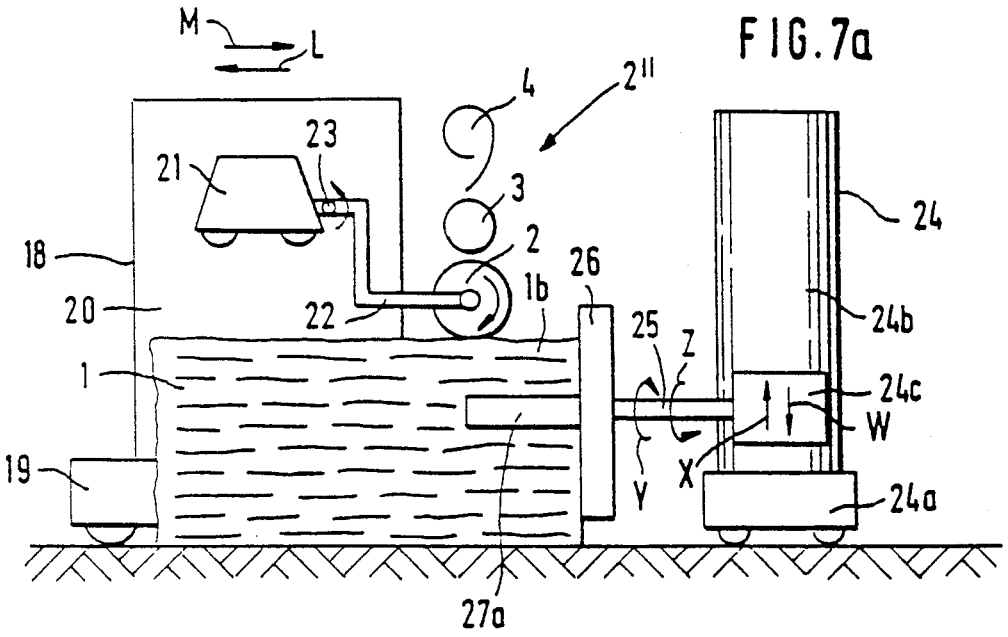
FIGS. 7*a* and 7*b* are a schematic side elevational and top plan views, respectively, of a system including a cleaning device according to the invention, a bale opener and a bale turning device.

In FIG. 7*a* there is shown a bale opener 18 which may be, for example, a BLENDOMAT BDT model manufactured by Trützschler GmbH & Co. KG, Mönchengladbach, Federal Republic of Germany. The bale opener 18 which may travel in the direction of the arrows L and M, has a carriage 19 and a tower 20 mounted on the carriage 19. A cantilever construction 21 which is mounted on the tower 20 and which is vertically movable relative thereto as indicated by the arrows Q, R houses the bale opening (fiber tuft-removing) device proper. A cleaning invention according to the device and designated at 2'' , including the cleaning roll 2, the stripping roll 3 and the collecting and suction removal device 4, is mounted laterally to the cantilever 21 by means of an arm 22. The arm 22 and thus the cleaning device 2'' are movable horizontally in the direction of the arrows 0, P so that the cleaning roll 2—whose length is less than the width of the surface 1*b* of the fiber bale 1—may work on the entire surface 1*b*. The arm 22 is pivotal about a rotary bearing 23, so that the cleaning roll 2 may be disengaged from the bale 1 and thus the opening (detaching) rolls of the bale opener 18 may work on the fiber bale 1. As shown in FIG. 7*c*, the cantilever 21 of the bale opener 18 may move the cleaning roll 2 vertically in the directions Q and R to perform strokes along the end face 1*c* of the fiber bale 1.

Figure 7B:
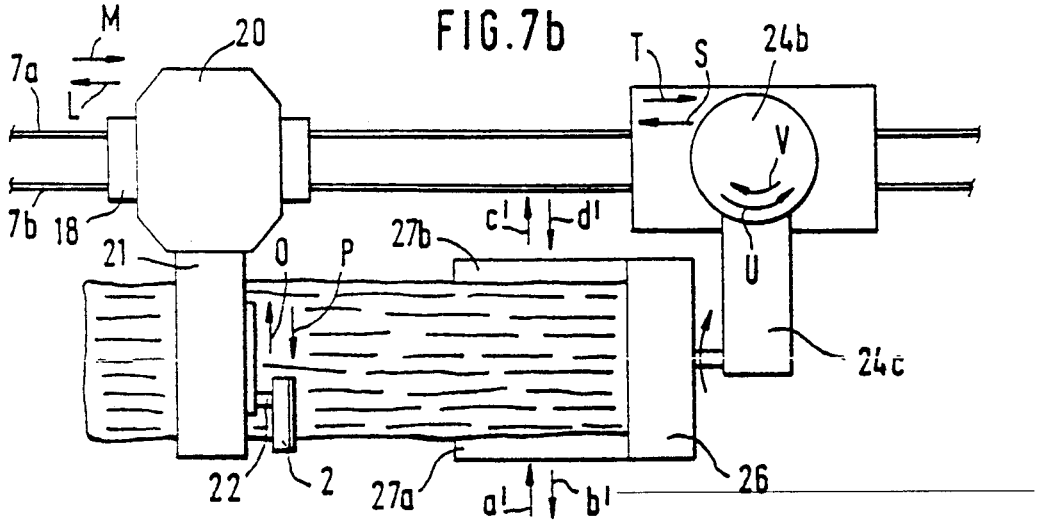
Figure 7C:
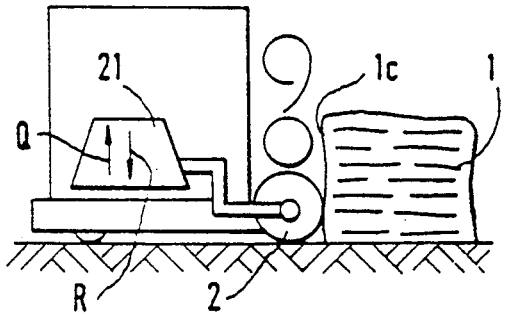
FIG. 7*c* is a schematic side elevational view of the bale opener and the cleaning device of FIG. 7*a*, shown in a different operational position.
Figure 7D:
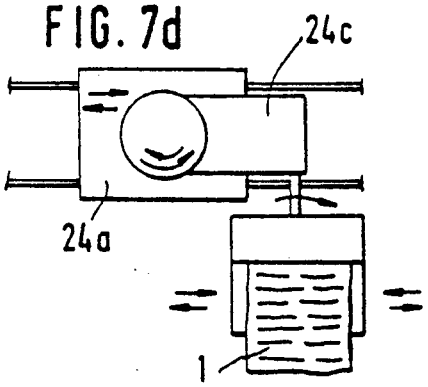
FIG. 7*d* is a schematic top plan view of the bale turning device of FIG. 7*b*, shown in a different operational position.

Reverting to FIG. 7*a* and also referring to FIGS. 7*b* and 7*d*, there is further shown therein a fork inverter 24 having a carriage 24*a* movable in the direction of arrows S, T on rails *7c*, *7d*. On the carriage 24*a* there is mounted a tower 24*b* which is rotatable in the direction of the arrows U, V and which has a lateral cantilever structure 24*c* which is movable vertically in the direction of the arrows W and X. Laterally of the cantilever 24*c* there is provided an abutment element 26 mounted on a shaft 25 rotatable in the direction of arrows Y, Z and having two grippers 27*a* and 27*b* which are movable in the direction of the arrows a', b' and, respectively, c' and d'. The bales 1 may be rotated by the fork inverter 24 such that all 6 surfaces 1*a*-If may be cleaned by the cleaning device 2".

As it may be observed particularly in FIGS. 4, 6 and *7b*, the cleaning roll 2 is substantially shorter than that dimension of the bale surface which is parallel to the longitudinal axis of rotation of the cleaning roll 2. The robot 6 acting in the direction H, I according to FIGS. 4, 6 and the mechanism acting in the direction O, P according to FIGS. *7a*-*7d* move the cleaning roll 2 parallel to its longitudinal axis for covering the entire bale surface in that direction.

It will be understood that the above description of the present invention is susceptible to various modifications, changes and adaptations, and the same are intended to be comprehended within the meaning and range of equivalents of the appended claims.

What is claimed is:

1. An apparatus for treating a fiber bale having a soiled surface, comprising (a) a cleaning device arranged for engaging a bale surface to remove soiled material therefrom;

(b) displacing means for effecting a relative motion between the fiber bale and the cleaning device; and (c) a bale turning means for changing the orientation of the bale surfaces.

2. An apparatus as defined in claim 1, further comprising a control device operatively connected to said cleaning device and said bale turning means.

3. An apparatus for treating a fiber bale having a soiled surface, comprising a cleaning device arranged for engaging a bale surface to remove soiled material therefrom and displacing means for effecting a relative motion between the fiber bale and the cleaning device; said displacing means comprising a multi-axis robot.

4. An apparatus as defined in claim 3, further comprising means for moving the fiber bale in a transporting direction and means for positioning said robot perpendicularly to said transporting direction.

5. An apparatus as defined in claim 3, further comprising first drive means for moving the robot and second drive means for moving the cleaning device and electric means connected to said first and second drive means for effecting a cleaning of all surfaces of the fiber bale.

6. An apparatus as defined in claim 3, further comprising a circular track arranged for surrounding the fiber bale; said robot being mounted on the circulate track for moving above the fiber bale.

7. An apparatus for treating a fiber bale having a soiled surface, comprising (a) a cleaning device arranged for engaging a bale surface to remove soiled material therefrom;

(b) movable camera means for displacement relative to the bale surface and for recognizing shades or colors of the bale surface;

(c) displacing means for effecting a relative motion between the fiber bale and the cleaning device; said displacing means including a multi-axis robot; and (d) a control device operatively connected to said camera means and said robot.

8. An apparatus as defined in claim 7, further comprising an image evaluating device connected with said camera means.

9. An apparatus for treating a fiber bale having a soiled surface, comprising a cleaning device arranged for engaging a bale surface to remove soiled material therefrom and displacing means for effecting a relative motion between the fiber bale and the cleaning device; said displacing means including a bale opener carrying said cleaning device; said bale opener being arranged for removing fiber tufts from the fiber bale subsequent to cleaning performed by said cleaning device.

10. An apparatus as defined in claim 9, wherein said bale opener has a carriage propelled along fiber bales; a tower mounted on the carriage; and a bale opening device cantilevered to the tower and movable vertically relative to the tower; said cleaning device being mounted on the bale opener.

11. An apparatus as defined in claim 9, wherein said cleaning device is mounted on the bale opening device.

12. An apparatus as defined in claim 10, wherein said cleaning device is mounted on the tower.

13. An apparatus for treating a fiber bale having a soiled surface, comprising (a) a cleaning device including a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface; and (b) displacing means for effecting a relative motion between the fiber bale and the cleaning roll; said displacing means including first and second pairs of conveyor belts for engaging opposite faces of the fiber bale and defining a clearance therebetween and for effecting a relative motion between the bale surface and the cleaning roll in a direction parallel to said longitudinal axis for reaching all areas of the bale surface along said dimension; said cleaning device being positioned such that said cleaning roll engages bale faces in said clearance.

14. An apparatus for treating a fiber bale having a soiled surface, comprising (a) a cleaning device including (1) a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface; and (2) a stripping roll cooperating with said cleaning roll for removing fiber material from said cleaning roll; and (b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension.

15. An apparatus as defined in claim 14, further comprising a collecting a suction removing means cooperating with said stripping roll for removing the soiled material from said stripping roll.

16. An apparatus as defined in claim 15, further comprising a stripping edge forming part of said collecting and suction removing means and cooperating with said stripping roll for removing the soiled material from said stripping roll.

17. An apparatus for treating a fiber bale having a soiled surface, comprising (a) a cleaning device including a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface; and (b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension; said displacing means including means for moving said cleaning roll in a horizontal direction along the base surface.

18. An apparatus as defined in claim 17, further comprising a sawtooth clothing arranged on said cleaning roll.

19. An apparatus as defined in claim 17, further comprising a hold-down means for pressing on the fiber bale surface adjacent the cleaning roll.

20. An apparatus for treating a fiber bale having a solid surface, comprising (a) a cleaning device including a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface; and (b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension; said displacing means including means for moving said cleaning roll in a vertical direction along the bale surface.

21. An apparatus for treating a fiber bale having a soiled surface, comprising (a) a cleaning device including (1) a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface; and (2) means for adjustably pressing said cleaning roll against the bale surface; and (b) displacing means for effecting a relative motion between the fiber bale and the cleaning roll; said displacing means including means for effecting a relative motion between the bale surface and the cleaning roll in a direction parallel to said longitudinal axis for reaching all areas of the base surface along said dimension.

22. An apparatus for treating a fiber bale having a soiled surface, comprising (a) a cleaning device including a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface;

(b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension; and (c) a collecting and suction removing means cooperating with said cleaning roll for removing the soiled material from said cleaning roll.

23. An apparatus for treating a fiber bale having a soiled surface, comprising (a) a cleaning device including a cleaning roll for engaging a bale surface to remove soiled material therefrom; said cleaning roll having a longitudinal axis of rotation and a length substantially less than a dimension of the bale surface measured parallel to the longitudinal axis of the cleaning roll when in engagement with the bale surface;

(b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension; and (c) movable camera means for displacement relative to the bale surface and for recognizing shades or colors of the bale surface.

24. An apparatus for treating a fiber bale having a soiled surface, comprising (a) a cleaning device including a cleaning roll for engaging a bale surface to remove said material therefrom; said cleaning roll having a longitudinal axis of rotation and a length of approximately 300 mm; said length being substantially less than a dimension of the bale surface measured parallel to the longitudinal axis of the cleaning roll when in engagement with the bale surface; and (b) displacing means for effecting a relative motion between the fiber bale and the cleaning roll; said displacing means including means for effecting a relative motion between the bale surface and the cleaning roll in a direction parallel to said longitudinal axis for reaching all areas of the bale surface along said dimension.

* * * * *